US005941753A

United States Patent [19]

Diresta

[11] Patent Number: 5,941,753

[45] Date of Patent: Aug. 24, 1999

[54] SPINNING TOPLET ASSEMBLY

[75] Inventor: James Diresta, Woodmere, N.Y.

[73] Assignee: 4 Kidz Inc., Stamford, Conn.

[21] Appl. No.: 09/002,449

[22] Filed: Jan. 2, 1998

[51] Int. Cl.[6] ..... A63H 1/18

[52] U.S. Cl. ..... 446/257; 446/69

[58] Field of Search ..... 446/691, 256–263

[56] References Cited

U.S. PATENT DOCUMENTS

| | | | |
|---|---|---|---|
| Re. 15,475 | 10/1922 | Gibbs | 446/257 |
| 737,431 | 8/1903 | Marx . | |
| 1,033,671 | 7/1912 | Campbell . | |
| 1,089,668 | 3/1914 | Prendegast . | |
| 1,985,657 | 12/1934 | Gustine | 446/257 |
| 2,619,769 | 12/1952 | Gallaher . | |
| 2,839,869 | 6/1958 | Lopez . | |
| 3,201,896 | 8/1965 | Dalhart . | |
| 5,518,437 | 5/1996 | Nonaka et al. | 446/259 |

OTHER PUBLICATIONS

Drawing of spinning top, acknowledged prior art

*Primary Examiner*—Robert A. Hafer
*Assistant Examiner*—Laura Fossum
*Attorney, Agent, or Firm*—Robert W. J. Usher

[57] ABSTRACT

A toplet assembly of inner, intermediate and outer toplets has releasable catches on respective housings of the outer and intermediate toplets which secure the intermediate and inner toplets to the outer and intermediate toplets, respectively, nested one inside another, on a common spin axis, for separation during spinning by floor impact, when dropped. The outer and intermediate toplets have respective pivot pins mounted in respective housings for limited axial sliding movement. Springs are connected between respective pivot pins of the outer and intermediate toplets and the respective housings of the intermediate and inner toplets to transmit upward axial movement of the pivot pins thereof, by a first floor impact to the intermediate toplet independently of the pivot pin thereof, thereby releasing only the catch of the outer toplet permitting ejection therefrom both the intermediate and inner toplets secured together as a subassembly and, by a subsequent floor impact of the subassembly, to release the catch of the intermediate toplet, permitting subsequent ejection of the inner toplet from the intermediate toplet. The toplet assembly has an upper face with concentric outer and inner sockets having ratchet teeth and a keyway, respectively, formed by outer and inner toplet housings, respectively, for engagement with ratchet arms and a spring powered spindle of a hand-held spinner.

3 Claims, 6 Drawing Sheets

SPINNING TOPLET ASSEMBLY

FIELD OF THE INVENTION

The invention relates to a spinning toplet assembly of the type comprising a plurality of toplets nested one inside the other which separate to spin individually while the assembly is spinning.

BACKGROUND OF THE INVENTION

There have been many prior attempts over several generations to provide such toplet assemblies, for example U.S. Pat. Nos. 737,431 issued 1903 to Marx; 1,033,671 issued 1912 to Campbell; 2,619,769 issued 1948 to Gallaher, and 2,839,869 issued 1955 to Lopez all teach plural toplet assemblies in which the individual toplets separate on casting the assembly as a result of the centrifugal forces produced by spinning.

The toplet assemblies are spun by manually pulling cords wound thereon which can produce substantial variations in spin speed with corresponding variations in the centrifugal forces which produce the toplet separation. It may, therefore, be difficult to obtain predictable and reliable separation of individual toplets, particularly in an assembly of three or more toplets and when spinning is attempted by children.

In contrast, U.S. Pat. No. 1,089,668 issued 1914 to Prendergast and U.S. Pat. No. 3,201,896 issued 1963 to Dalhart, teach top assemblies in which the individual toplets are separated by impact of the spinning assembly with a floor surface on which the assembly is dropped. However, the rigidity of the assembly taught may increase the risk of damage to the toplets by repeated floor impact, reducing life.

More particularly, Dalhart also teaches a construction in which only a single ground impact causes separation of all the toplets with the innermost, smallest, of three toplets ejected first from the intermediate toplet, which is then ejected from the outer toplet.

In addition, the operation required in all the above-mentioned patents of manually winding and pulling cords to spin the toplets can be relatively time consuming and bothersome also requiring a degree of manual dexterity, possibly beyond the capabilities of some very small children who would otherwise derive considerable pleasure from spinning tops.

SUMMARY OF THE INVENTION

It is an object of the invention to provide a toplet assembly of the above type which overcomes or ameliorates at least some of the above-mentioned disadvantages.

It is another object of the invention to provide a toplet assembly which can be spun by a hand held, spring powered, spinner device enabling operation of the toplet assembly even by small children.

It is a further object of the invention to provide a toplet assembly which is of durable construction and yet can be manufactured economically by conventional mass production techniques.

It is an additional object of the invention to provide an assembly of at least three toplets in which the individual toplets are separated successively, in predictable and reliable fashion by repeated impacts with the floor.

It is yet another object of the invention to provide such assembly in which a subassembly of the innermost and intermediate toplet are ejected from the outer toplet by a first impact of the assembly with the floor and the innermost toplet is ejected from the intermediate toplet by a subsequent impact of the subassembly with the floor.

In a known a combination comprising a spinning top and a hand-held, spring powered spinner, the spinning top being of a type having a housing with an upper face formed with concentric outer and inner sockets for engagement with the spinner, the outer socket having a cylindrical inside wall surface formed with a series of ratchet teeth and the inner socket having a keyway, the spinner being of a type having a housing with a top engaging front face formed with a plurality of ratchet arms and a spring powered spindle having a drive head of complementary section to the keyway mounted centrally of the top engaging face for limited axial movement between rear winding positions and forward ejection positions and for rotation relative to the ratchet arms, so that when the spinner housing is pressed against the upper face of the top, the ratchet arms are received in the outer socket for engagement with the ratchet teeth and the drive head is received in driving engagement in the keyway, permitting winding of the spring by relative rotation of the housing and top, and so that the top is spun by advancing the spindle to the axially forward position thereby pushing the top from the front face of the spinner with disengagement of the ratchet teeth from the ratchet arms permitting spring driven rotation of the spindle and release of the top in spinning condition; the invention providing the improvement that the spinning top is a toplet assembly comprising an inner and an outer toplet releasably secured together nested one inside the other, on a common axis of spin, for separation during spinning by impact with a floor surface when dropped and the outer socket is formed by a wall portion on a housing of the outer toplet and the inner socket is formed by a wall portion of a housing of the inner toplet.

This construction has the advantage of enabling the use of a conventional hand-held spring powered spinner to avoid laborious cord winding operations in a toplet assembly which separates into individual spinning toplets.

Preferably, the inner socket is formed with a pair of oppositely inclined guide ramps on respective opposite sides of the keyway for guiding engagement by the drive head. This facilitates entry and exit of the drive head into the keyway and out from the keyway for clean release and spinning.

According to another aspect, the invention provides a toplet assembly of a type comprising an inner toplet, an intermediate toplet and an outer toplet having respective housings, and releasable catch means on the housing of the outer toplet and on the housing of the intermediate toplet securing the intermediate toplet to the outer toplet and the inner toplet to the intermediate toplet, nested one inside another, on a common spin axis, for separation during spinning by floor impact, when dropped, the outer and intermediate toplets having respective housings with respective pivot pins mounted in respective housings thereof for limited axial sliding movement so that the floor impact depresses the outermost pin upward into the housing of the outer toplet to release the catch means permitting ejection of the intermediate and inner toplets from the outer toplet, the improvement residing in that means are provided in the housing of the outer toplet for transmitting upward movement of the pivot pin thereof by a first floor impact to the housing of the intermediate toplet independently of the pivot pin of the intermediate toplet and thereby to release only the catch means on the housing of the outer toplet thereby permitting ejection from the outer toplet of both the intermediate toplet and inner toplet secured together as a subassembly, means being provided in the housing of the intermediate toplet for transmitting upward movement of the pivot pin thereof by a subsequent floor impact of the subassembly causing upward depression of the pivot pin of the intermediate toplet into the housing thereof to effect release of the catch means thereon thereby permitting ejection of the inner toplet from the intermediate toplet.

Preferably, the transmitting means in the housings of the outer toplet and intermediate toplet comprise compression springs connected between respective pivot pins of the outer and intermediate toplets and the respective housings of the intermediate and inner toplets. This both reduces risk of damage to the toplets caused by floor impact and assists in ejection of the toplet subassembly to a sufficient height to ensure sufficient subsequent impact to release and eject the inner toplet from the intermediate toplet.

BRIEF DESCRIPTION OF THE DRAWINGS

In order that the invention may be readily understood, a specific embodiment thereof will now be described by way of example only and with reference to the accompany drawings, in which.

DESCRIPTION OF PARTICULAR EMBODIMENTS

Figure 1:
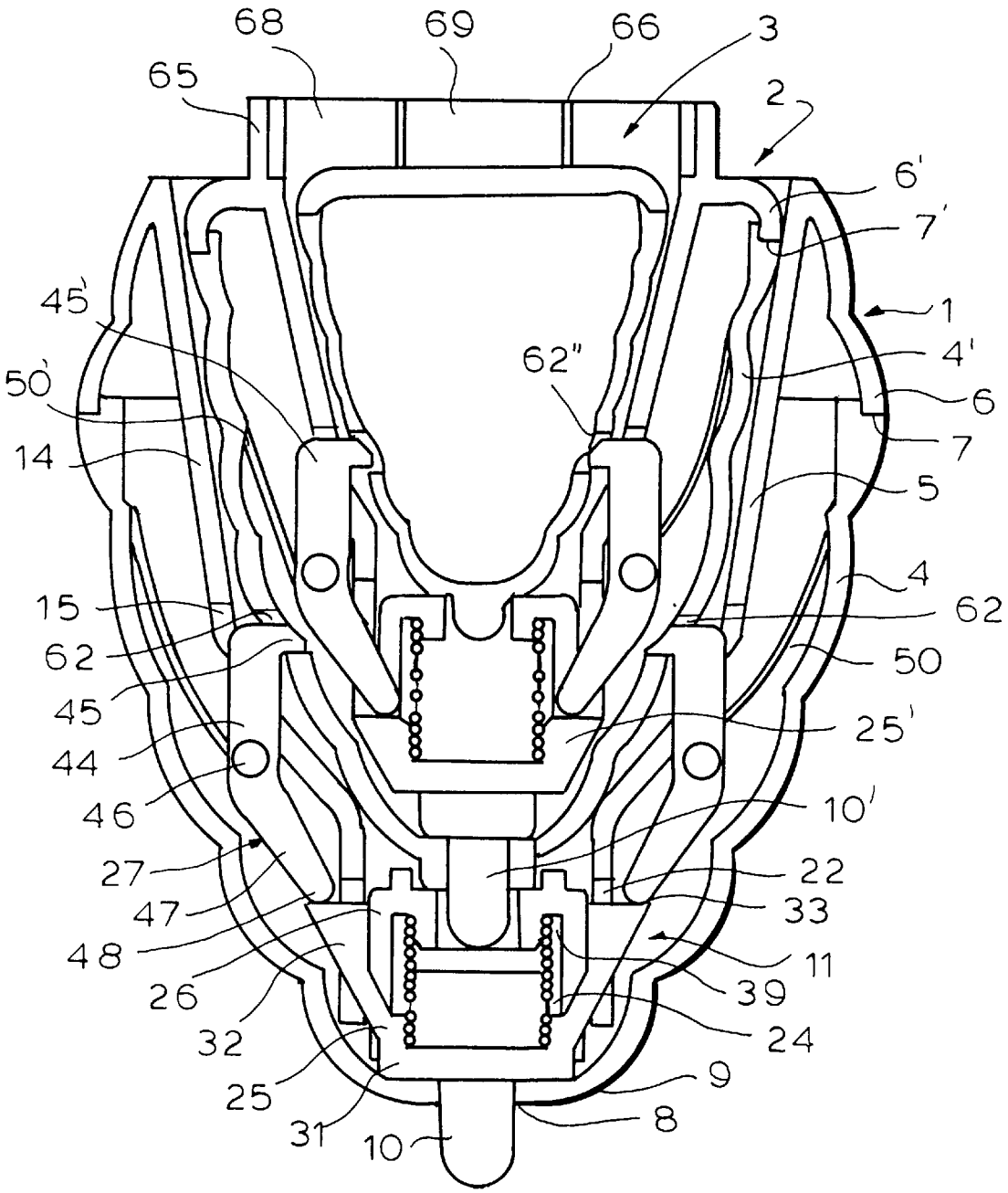
FIG. 1 is a schematic axial cross-sectional view of the toplet assembly, with background detail omitted for clarity.

As shown in FIGS. 1–4, the toplet assembly comprises outer, intermediate and inner toplets, 1, 2 and 3, respectively, of progressively diminishing size, nested together. As the intermediate toplet 2 has many similarities in construction to the outer toplet 1, for brevity, similar parts of the intermediate toplet will be identified by primed reference numerals.

Figure 5:
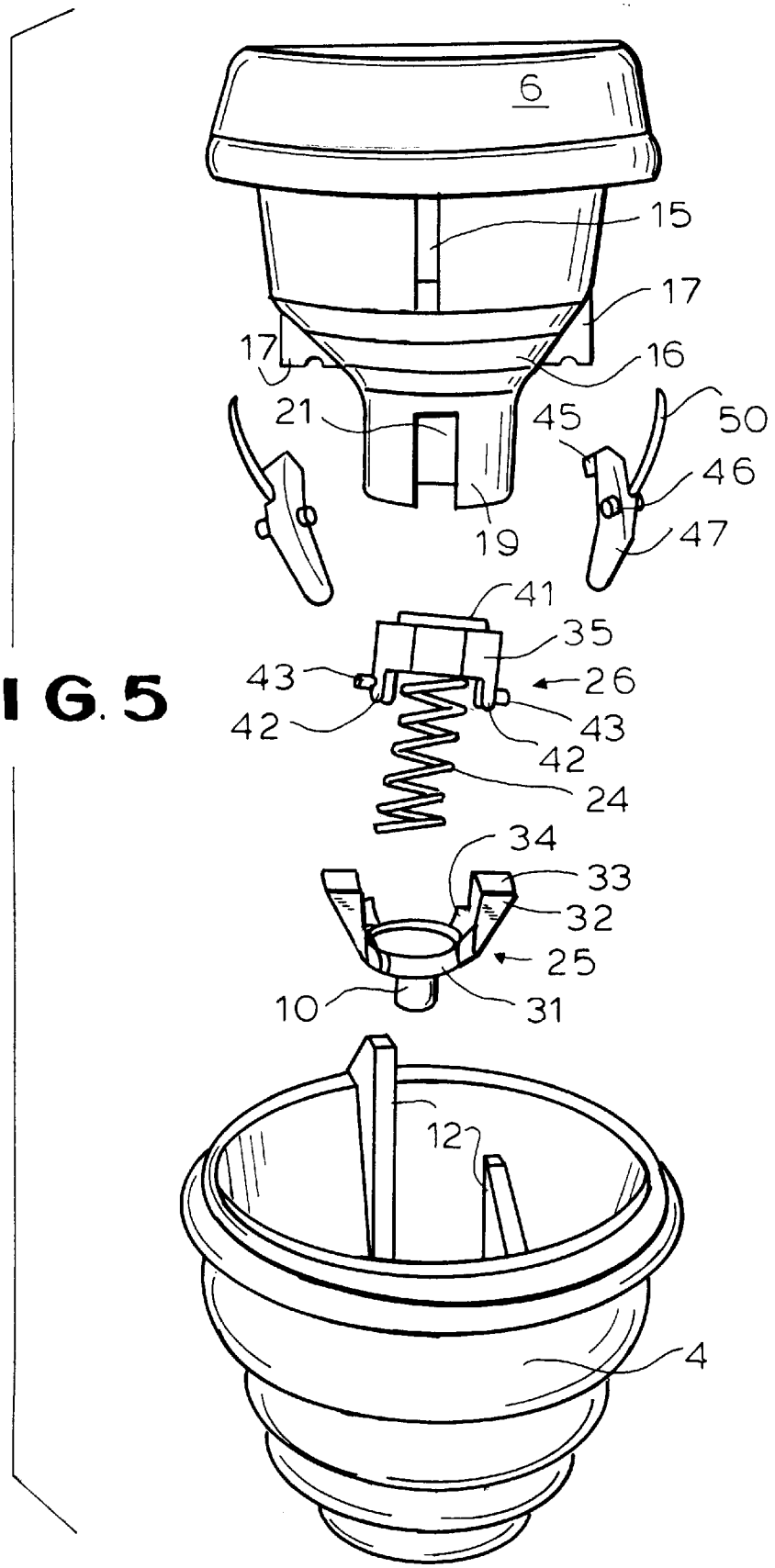
FIG. 5 is an exploded perspective view of an outer toplet of the assembly.
Figure 6:
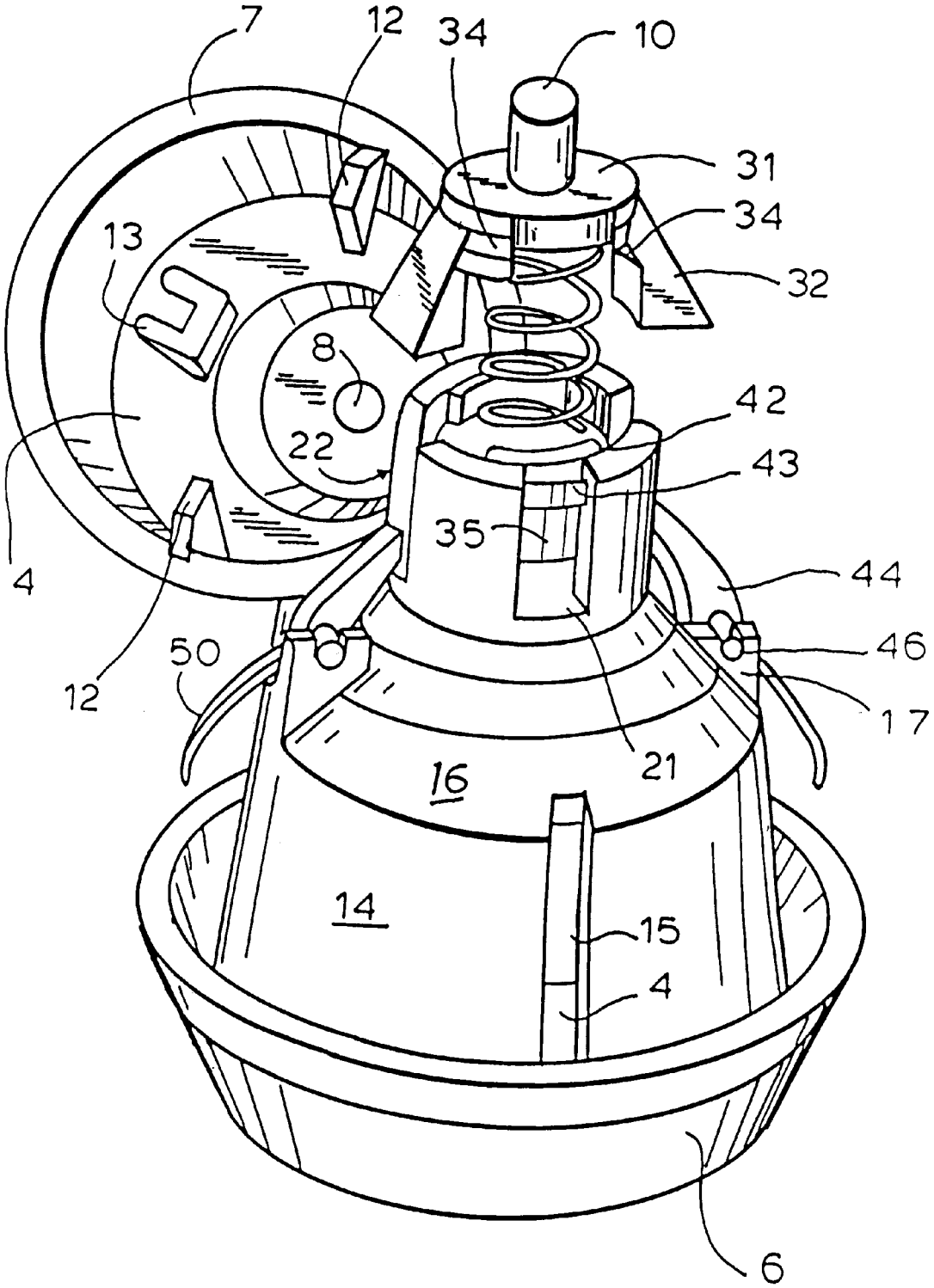
FIG. 6 is a perspective view of the assembly with an outer half-shell of the outer toplet removed.

As shown also in FIGS. 5 and 6, the outer toplet 1 comprises conical, outer, and generally frusto-conical, inner half-shells 4 and 5. The base of the inner half-shell is molded with an out-turned and upturned skirt 6 to which the base 7 of the outer half-shell is secured by adhesive (or welding) thereby permanently attaching the half-shells together. The outer half-shell 4 has an aperture 8 in the apex 9 thereof for sliding receipt of a pivot pin 10 of a toplet capture and ejection mechanism 11 described below, and an inner surface of the outer half-shell is molded with a pair of rigid, diametrically opposed, axially extending, locating ribs 12 which protrude beyond the base 7 and a pair of diametrically opposed bearing parts 13, (see FIG. 6).

The inner half-shell 5 has a medial body portion 14 formed with a pair of diametrically opposed, locating and guiding slots 15; a tapering shoulder portion 16 molded at diametrically opposite locations with complementary bearing parts 17, (see FIGS. 5 and 6); and a castellated head portion 19 providing first and second pairs of diametrically opposed slots 21 and 22, respectively, for receiving parts of the toplet capture and ejection mechanism 11.

Figure 2:
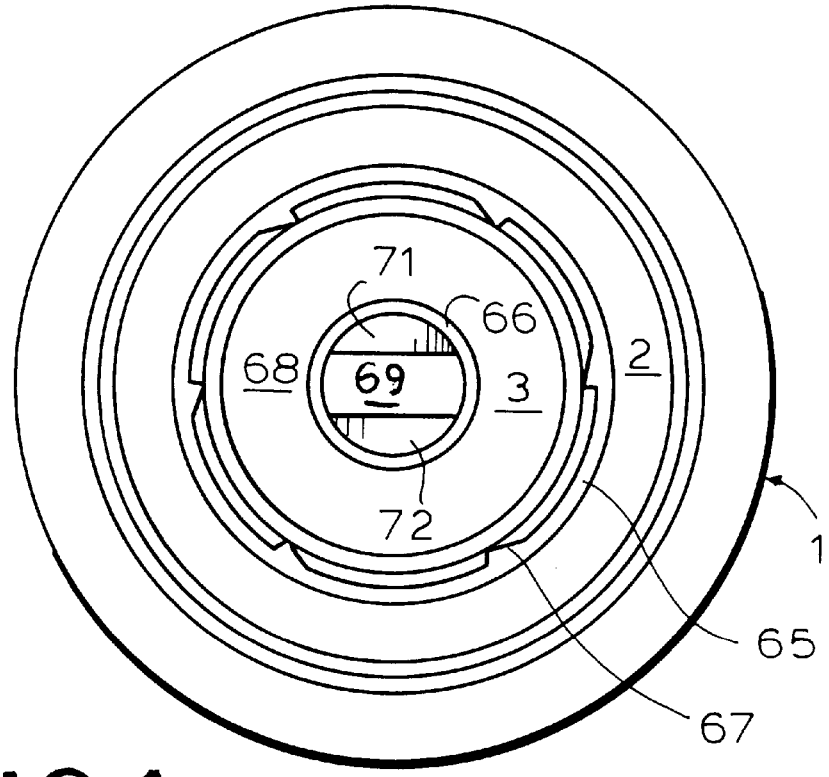
FIG. 2 is top plan view of the assembly of FIG. 1 with background detail omitted for clarity.
Figure 4:
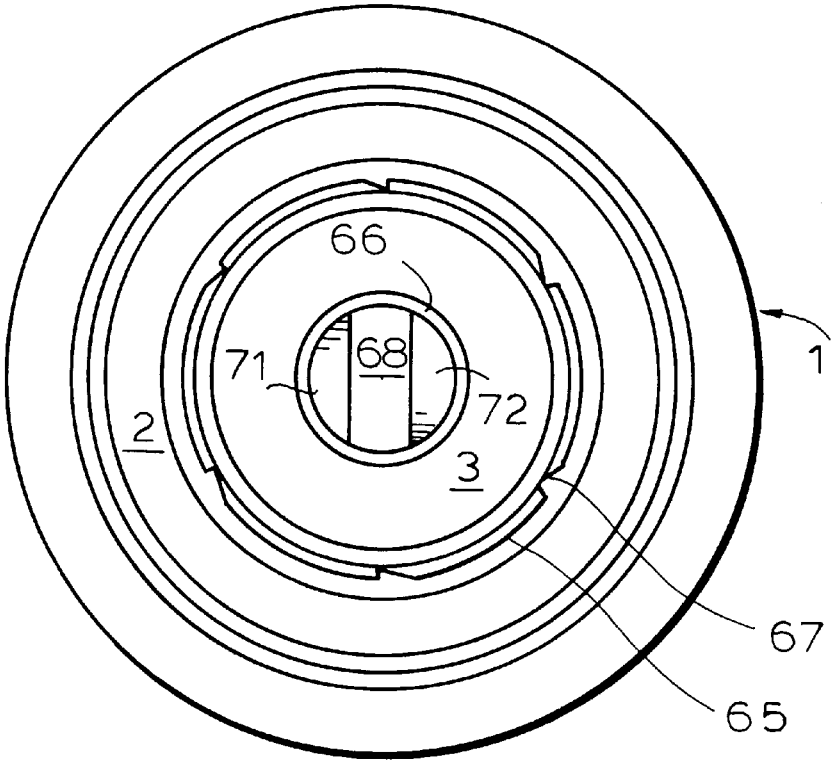
FIG. 4 is top plan view of the assembly of FIG. 3 with background detail omitted for clarity.

The toplet capture and ejection mechanism 11 comprises a coil spring 24 one-piece, lower and upper end caps 25 and 26, respectively, (as seen in FIGS. 1, 2 and 5), trapping the spring and a pair of resilient catch means 27. The lower end cap 25 has a dished, disk-like, central spring receiving portion 31, from the center of which the pivot pin 10 depends, and a pair of wings 32 projecting radially outward and upward in the spring direction from respective diametrically opposite edges with free ends forming flat bearing surfaces 33 operatively engaged with the catch means 27, as described below. Guide/stop lugs 34 are formed adjacent root ends of the wings 32. The upper cap 26 is formed with concentric, outer and inner cylindrical wall portions 35 and 36, respectively, joined by an annular wall portion 38 at an upper end to provide between them an annular socket 39 receiving the upper end of the spring 24. A lower end of the inner wall portion is closed forming a socket 40 for receipt of the pivot pin 10' of the intermediate top 2 and the wall portion 38 has an annular, upstanding lip 41 for locating a suitably profiled apex 9' of the outer half-shell 4' of the intermediate top 2. A pair of lugs 42 depend, as axial extensions, from opposite diametrical locations of the lower, free end of the outer wall portion 35 and carry radially outward extending guiding ears 43.

The resilient catch means comprises a pair of essentially rigid lever arms 44 formed with hooked catch portions 45 at upper ends, pivoted centrally on trunnions 46, and having inwardly angled actuating portions 47 tapering to lower free ends 48. Metal leaf biasing springs 50 are secured on the catch side of the trunnions to extend outward beyond the catch portions.

The wings 32' of the lower end cap 25' of the intermediate toplet 2 are shorter than those of the end cap 25 together with other minor dimensional and configurative changes shown in the drawing, while in the upper end cap 26', the lip 41 is omitted and the socket 42' receiving the fixed pivot 10" of the inner toplet 3 is open-ended.

In a modification, instead of providing separate lever form catch arms with separate biassing springs, and the wings for positive release by the movement of the pivot pin, lower ends of catch arms may be integrally molded with the shells of the outer and intermediate toplet, the plastic material providing the stiff resilient flexure necessary for capture and release of the intermediate and inner toplets, respectively, with the catch arms normally being in the capture position and flexed out from retaining engagement with the respective inner toplets solely by the ejection force applied by the spring to the inner toplets.

Figure 3:
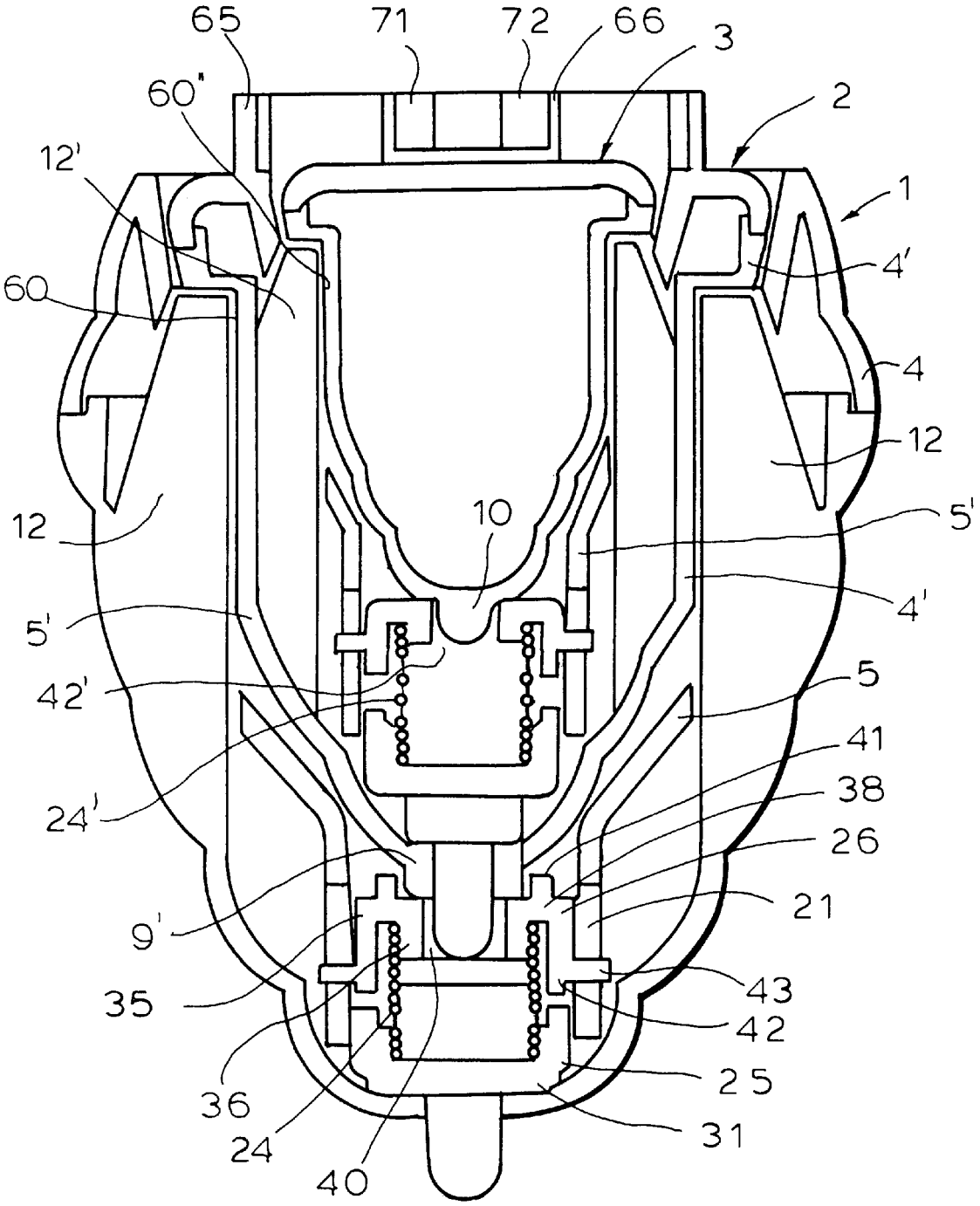
FIG. 3 is a similar view to FIG. 1, but taken in an orthogonal plane.

The intermediate and innermost toplets 2 and 3, differ from the outer toplet in that, as shown in FIGS. 1 and 3, the walls of their outer half shells are molded with axially extending toplet locating groves 60, 60" at diametrically opposite locations and latching apertures 62, 62" orthogonally located with respect to the grooves.

Assembling the outer half shell on the remainder of the assembly shown in FIG. 6, brings the bearing parts 13 and 17 into cooperate engagement, trapping the trunions with the biassing spring 50 flexed against the outer half-shell to bias the catches inward, protruding through the slots 22 into a toplet capture position while the ribs 12 protrude through the slots 15 for engagement with the grooves 60. Cylindrical walls 65 and 66, respectively, upstand from the upper faces of the intermediate and innermost toplets, respectively, defining outer and inner coaxial sockets 68 and 69, respectively, for operative engagement with ratchet arms and key of a winding mechanism of a spring operated, hand held spinner device of the prior art, shown in FIGS. 7 and 8. The inner circumference of the outer wall is formed with ratchet teeth 67. The inner socket 91 is of substantially rectangular section being defined between two ramp surfaces 71, 72 inclined in opposite senses to facilitate entry and exit of the drive head of a key or spindle. It is acknowledged as prior art to provide the upper face of a single top with the structures described above in this paragraph for engagement with a hand held spinner described below, but not to provide the spinner engaging structures on separate toplets, as described.

In the fully assembled condition, the lower and upper spring caps, 25 and 26, are located on the head portion 16 of the inner half-shell, 5 trapping the spring 10 between them with the wings 32 received for axial sliding movement along slots 22 and the bearing surfaces 33 engaging the tips 48 of the catch arms 44. The sliding movement is limited by the apex 9 of the outer half shell and the engagement of the stops 34 with the free end of the head portion 16. The upper cap 26 is received for axial sliding movement within the head portion with the ears 43 located in the slots 21. The wall 38 abuts the apex 9' of the intermediate toplet which limits the upper position thereof while the catches are in latching engagement in the apertures 15. The ribs 12' of the intermediate toplet 2 are similarly received in the grooves 60" with the catches 45 engaging in the apertures 62".

The toplets can be assembled simply by successively pressing the intermediate and inner toplets into the outer toplet with the respective grooves 60, 60" receiving the ribs 12, 12' in guiding relation causing the upper chamfered surfaces of the hooks 45, 45' to be cammed outward by engagement with the toplets' surfaces, against the action of the return springs 50, 50', until entering the respective latching apertures 62, 62" with a snap action.

Figure 7:
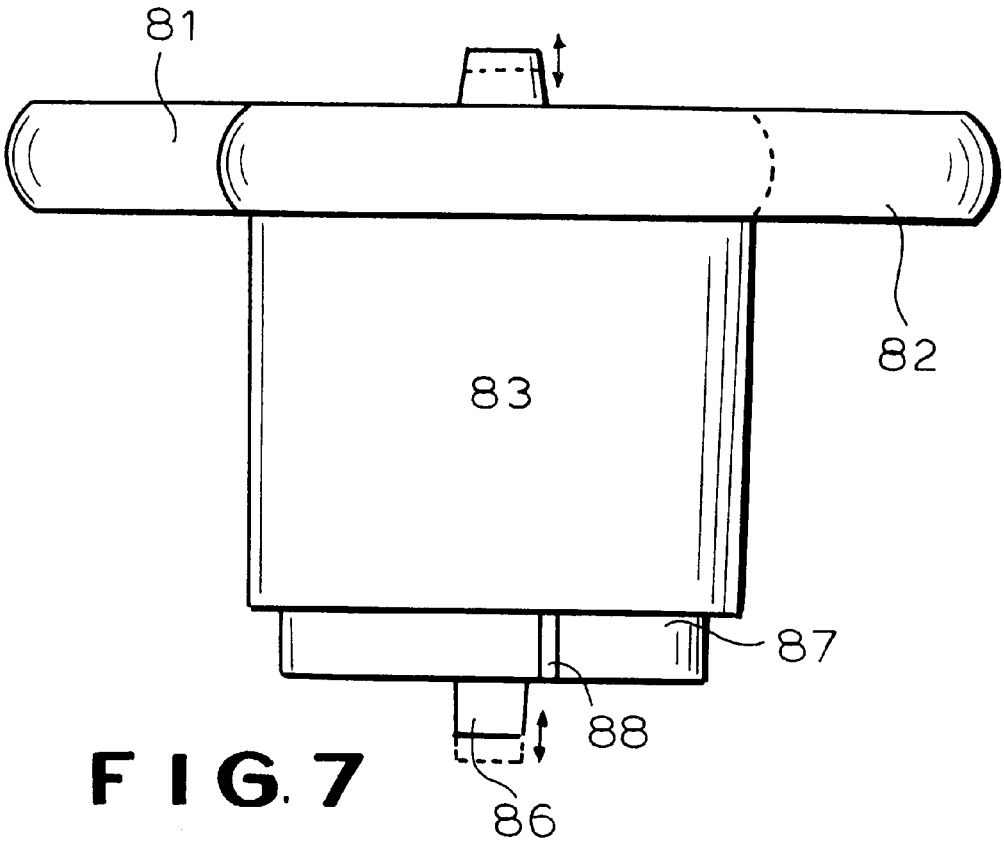
FIG. 7 PRIOR ART
FIG. 7 is a side elevation of a spring powered top spinner device.
Figure 8:
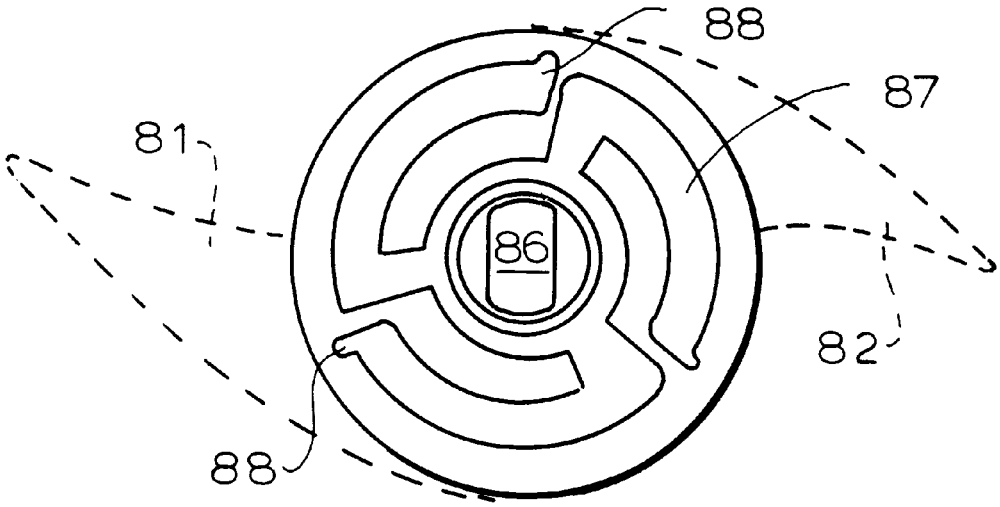
FIG. 8 PRIOR ART
FIG. 8 is a plan view of top engaging actuating head of the spinner of FIG. 7.

As shown in FIGS. 7 and 8, the prior art spinner, sold by Goldfish Ltd., comprises fingerpieces 81, 82 which protrude radially outwardly from a top of a central cylindrical housing 83 through which a key or spindle 85 is mounted both rotatively and for limited axial movement between a rear winding position shown in solid lines, and an advanced or forward ejection position shown in broken lines, in which it protrudes a maximum distance from the engaging face of the housing. The spindle carries a coil spring (not shown) having opposite ends secured to the axle and housing, respectively, so that relative rotation of the key and housing winds the spring. The key is formed with a rectangular section drive head 86 protruding from a front, top engaging face of the housing and the housing face is integrally molded with three locking arms with resiliently flexible, circumferentially extending portions 87 terminating in free ends having radially outward locking nibs 88. Application of the head to the upper face of the toplet assembly, with the spindle in either the winding or advanced position brings respective arms 87 into the outer socket 68 so that the nibs 88 will be brought into locking engagement with three of the teeth 67 on relative rotation in one direction, with the arms flexing over the teeth to permit rotation in only the other direction, ratchet fashion, and the drive head 86 is guided by engagement with the ramp surfaces 72 into the inner socket 69. In this condition, the spindle will be in the rear, winding position (possibly forced by the application).

Rotation of the housing by grasping the fingerpiece in one hand and the toplet assembly in the other will wind the spring, reverse rotation being prevented by the ratchet action. When the spring is fully wound, the user releases the toplet assembly which remains held to the spinner gripped by the arms, and depresses the rear end 89 of the key toward the housing, thereby advancing the head to the forward, ejection position which pushes the upper face of the toplet assembly axially away, disengaging the spring fingers from the teeth enabling the key to be rotated rapidly by the unwinding action of the spring rotating the toplet assembly. Rotation of the toplet assembly as a single unit is assured by the engagement of the ribs 12, 12' in the grooves and the latching heads 45, 45' in the apertures 62, 62".

In operation, the toplet assembly is spun by the spinner device and dropped onto a suitable surface, such a hard floor, so that the initial impact depresses the pivot pin 10 into the toplet assembly raising the lower spring cap 25 so that the ends 33 of the wings 32 pivot the catch arms 44 outward against the action of the return springs 50 withdrawing the hooks 45 from the apertures 62, thereby releasing the intermediate toplet. At the same time, the upward movement of the lower spring cap 25 compresses ejection spring 24, transmitting an impulse to the upper cap 26 which ejects the spinning subassembly of the intermediate and innermost toplets upward out of the outer toplet 3 by engagement with the apex of the outer half-shell 4'. When the spinning subassembly next hits the floor, the impact depresses the pivot pin 10' of the intermediate toplet 2 causing the upward ejection of the innermost spinning toplet in similar manner, resulting in three, independently spinning toplets.

I claim:

1. A toplet assembly of a type comprising an inner toplet, an intermediate toplet and an outer toplet having respective housings, and releasable catch means on the housing of the outer toplet and on the housing of the intermediate toplet securing the intermediate toplet to the outer toplet and the inner toplet to the intermediate toplet, nested one inside another, on a common spin axis, for separation during spinning by floor impact, when dropped, the outer and intermediate toplets having respective housings with respective pivot pins mounted in respective housings thereof for limited axial sliding movement so that the floor impact depresses the outermost pin upward into the housing of the outer toplet to release the catch means permitting ejection of the intermediate and inner toplets from the outer toplet, the improvement residing in that means are provided in the housing of the outer toplet for transmitting upward movement of the pivot pin thereof by a first floor impact to the housing of the intermediate toplet independently of the pivot pin of the intermediate toplet and thereby to release only the catch means on the housing of the outer toplet thereby permitting ejection from the outer toplet of both the intermediate toplet and inner toplet secured together as a subassembly, means being provided in the housing of the intermediate toplet for transmitting upward movement of the pivot pin thereof by a subsequent floor impact of the subassembly causing upward depression of the pivot pin of the intermediate toplet into the housing thereof to effect release of the catch means thereon thereby permitting ejection of the inner toplet from the intermediate toplet.

2. A toplet assembly according to claim 1 wherein the transmitting means in the housings of the outer toplet and intermediate toplet comprise compression springs connected respectively between respective pivot pins of the outer and intermediate toplets and the respective housings of the intermediate and inner toplets.

3. A toplet assembly according to claim 1 wherein the transmitting means in the housings of the outer toplet and intermediate toplet comprise compression springs connected respectively between respective pivot pins of the outer and intermediate toplets and the respective housings of the intermediate and inner toplets.

* * * * *